United States Patent [19]

Stålfors

[11] 3,946,675

[45] Mar. 30, 1976

[54] POWER-GENERATING DEVICE FOR A PROJECTILE, SHELL, ETC.

[75] Inventor: Rolf Lennart Stålfors, Karlskoga, Sweden

[73] Assignee: AB Bofors, Bofors, Sweden

[22] Filed: July 10, 1974

[21] Appl. No.: 487,103

[30] Foreign Application Priority Data

Aug. 3, 1973 Sweden ..... 73106775

[52] U.S. Cl. ..... 102/70.2 G; 102/70.2 P; 136/205; 136/236 R

[51] Int. Cl.[2] ..... F42C 13/02; H01L 35/00

[58] Field of Search ..... 102/70.2 P, 70.2 R, 70.2 G; 136/205, 236

[56] References Cited

UNITED STATES PATENTS

| | | | |
|---|---|---|---|
| 2,137,598 | 11/1938 | Vos | 102/70.2 P |
| 3,006,978 | 10/1961 | McGrath et al. | 136/236 |
| 3,088,988 | 5/1963 | Menke | 136/205 |
| 3,323,459 | 6/1967 | Buffet | 102/70.2 G |

*Primary Examiner*—Charles T. Jordan
*Attorney, Agent, or Firm*—Elliott I. Pollock

[57] ABSTRACT

A projectile of the type containing a payload and a heat source spaced from said payload and activated while the projectile is in flight, is provided with a power-generating device comprising a number of thermo elements which are connected in series at a plurality of hot and cold junctions. The hot junctions are disposed adjacent the heat source within said projectile, and the cold junctions are spaced from said heat source and located adjacent the payload. The heat source may constitute a source of radiant energy associated with the transmitter portion of a proximity fuze, and the power-generating device may in turn energize the receiver portion of the fuze to control initiation of the payload.

6 Claims, 3 Drawing Figures

POWER-GENERATING DEVICE FOR A PROJECTILE, SHELL, ETC.

The present invention relates to a power-generating device for a projectile, shell, etc which has a source of heat which is activated while the projectile is in its air trajectory, as well as a space allotted to a payload, e.g. a bursting charge.

For ammunition of this kind, there is often a need for a source of electric power in order to provide for the initiation of the payload, and as an example of this can be mentioned projectiles or shells which are equipped with proximity fuzes which comprise a transmitter unit for transmitting radiant energy and a receiver unit for receiving and processing radiant energy reflected from a target. The present invention is intended to be utilized for, among other things, an anti-aircraft projectile, in which electronic equipment in the receiver unit of the proximity fuze must first be fed with electric power during the major portion of the time the projectile is in its trajectory and thereafter must also provide a source of electric power for the actual payload initiating procedure.

It is particularly advantageous to use the present invention in those cases where the projectile, shell etc. is provided with a pyrotechnical charge which generates the radiant energy emitted from the transmitter unit of the proximity fuze.

The power-generating device proposed according to the invention is also advantageous from the point of view of storage, and the feature that can mainly be considered to be characteristic of said device resides in the provision of a number of thermo elements which are joined together at hot and cold junctions or soldering points, the hot soldering points being positioned adjacent the source of heat which generates the transmitted radiant energy, and the cold soldering points being remote from said source of heat and being located adjacent the space provided for the payload.

Figure 3:
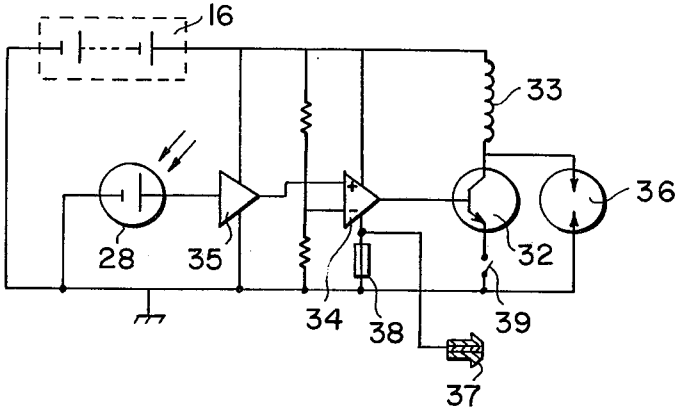

An embodiment proposed at present which has the characteristics that are significant for a device according to the invention will be described in the following, with reference to the attached drawings, in which FIG. 1 in cross-section shows an anti-aircraft projectile with an IR proximity fuze utilizing the invention, FIG. 2 in cross-section and enlargment shows a part of the projectile according to FIG. 1 and FIG. 3 in a schematic form shows electronic equipment which is provided with electric power from the device according to the invention.

Figure 1:
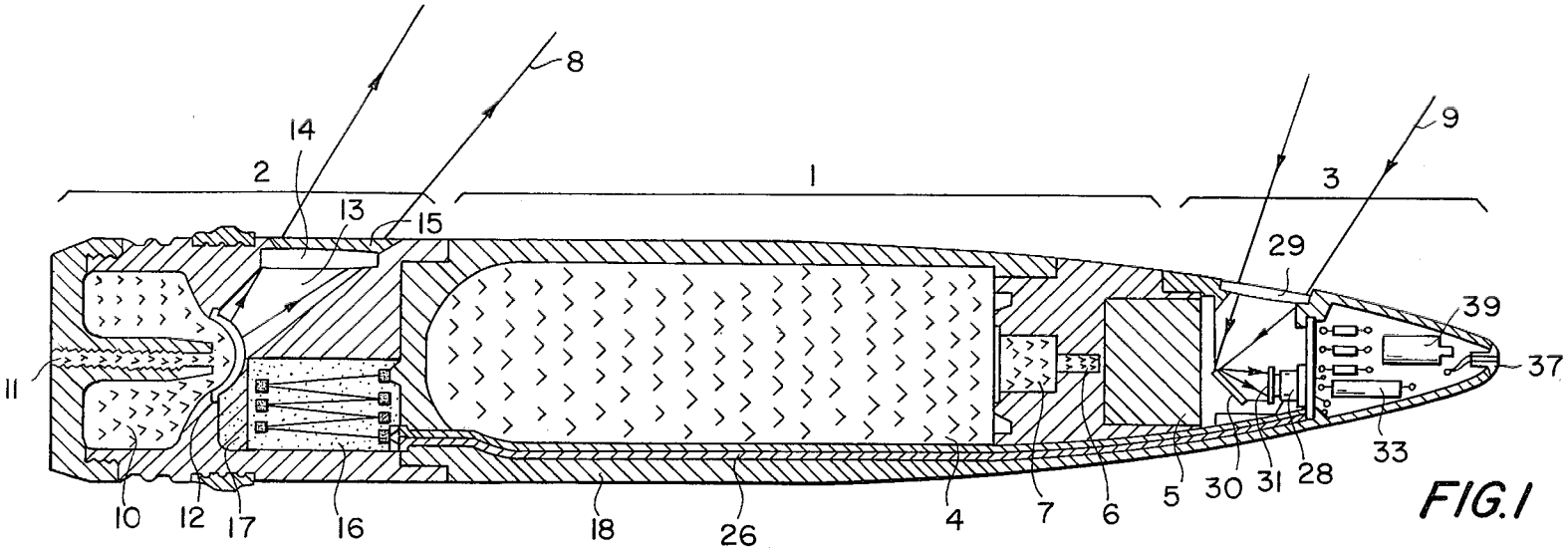

The projectile according to FIG. 1 comprises, in principle, three parts, viz. an effect part 1 and two units 2 and 3 which comprises an IR proximity fuze, the unit 2 being the transmitter unit of the proximity fuze and the unit 3 its receiver unit. The effect part 1 contains a bursting charge 4 associated with initiating members 5–7, of which 5 is a conventional delayed-arming device, 6 is a priming charge which can be initiated via the delayed-arming device and 7 is a bottom charge which achieves the final initiation of the bursting charge 4. The delayed-arming device 5 includes a gap igniter which is activated by means of electronic equipment in the receiver unit 3.

The proximity fuze works with a transmitter beam 8 emitted from the transmitter unit 2 and a receiver beam 9 for the receiver unit 3, so that when parts of the radiant energy emitted in the transmitter beam are reflected against an object and received in the receiver, the proximity fuze actuates the initiating members 5–7 for initiation of the bursting charge 4.

The radiant energy emitted from the transmitter unit 2 is obtained from a pyrotechnical charge 10 which is located in the rear section of the projectile. Said pyrotechnical charge 10 is ignited in connection with or shortly after the projectile has been fired from a gun barrel, and the ignition then takes place via a delay charge 11. The channel for the delay charge 11 is utilized after the ignition of the pyrotechnical charge 10 as an exhaust channel for the exhaust gases from the charge 10. The pyrotechnical charge 10 heats a membrane 12, which functions as a source of radiation, to a high temperature (approx. 2800°C). The membrane 12 is fastened at one end of a channel 13 which is directed obliquely forwards and outwards and emerges at its other end in the side of the projectile. At the opening of said channel 13 there is a lens 14, covered with a protective cover 15, which lens determines the ellipsoidal form of the transmitter beam. The cover 15 is made of plastic or a corresponding material, and when the projectile is fired, it is thrown to the side and broken up by the centrifugal force.

The projectile supports a device 16 for generating electric power, according to the invention, at a part of the projectile separating the pyrotechnical charge 10 and the bursting charge 4, and which part extends in the longitudinal direction of the projectile and is substantially equal in length to the length of the space for the pyrotechnical charge 10. The device 16 constitutes a thermocouple which comprises a number of thermo elements connected in series. The elements are joined together at hot and cold soldering points, which in FIG. 1 are represented by squares, the left squares representing the hot soldering points and the right squares representing the cold soldering points. The hot soldering points are located adjacent the pyrotechnical charge 10 and said membrane 12 and are subjected to heat therefrom via a heat-dispersing medium 17, e.g. fabricated of copper, which distributes the high temperature uniformly over the hot soldering points. Through the position shown and the centrifugal forces that arise it is of minor importance if the copper medium 17 is melted by the high temperature, as it is retained in its position at all events. The cold soldering points are directed towards and located adjacent the space provided for the bursting charge 4, which is enclosed in a casing 18 which, for obvious reasons, has a high heat capacity.

Figure 2:
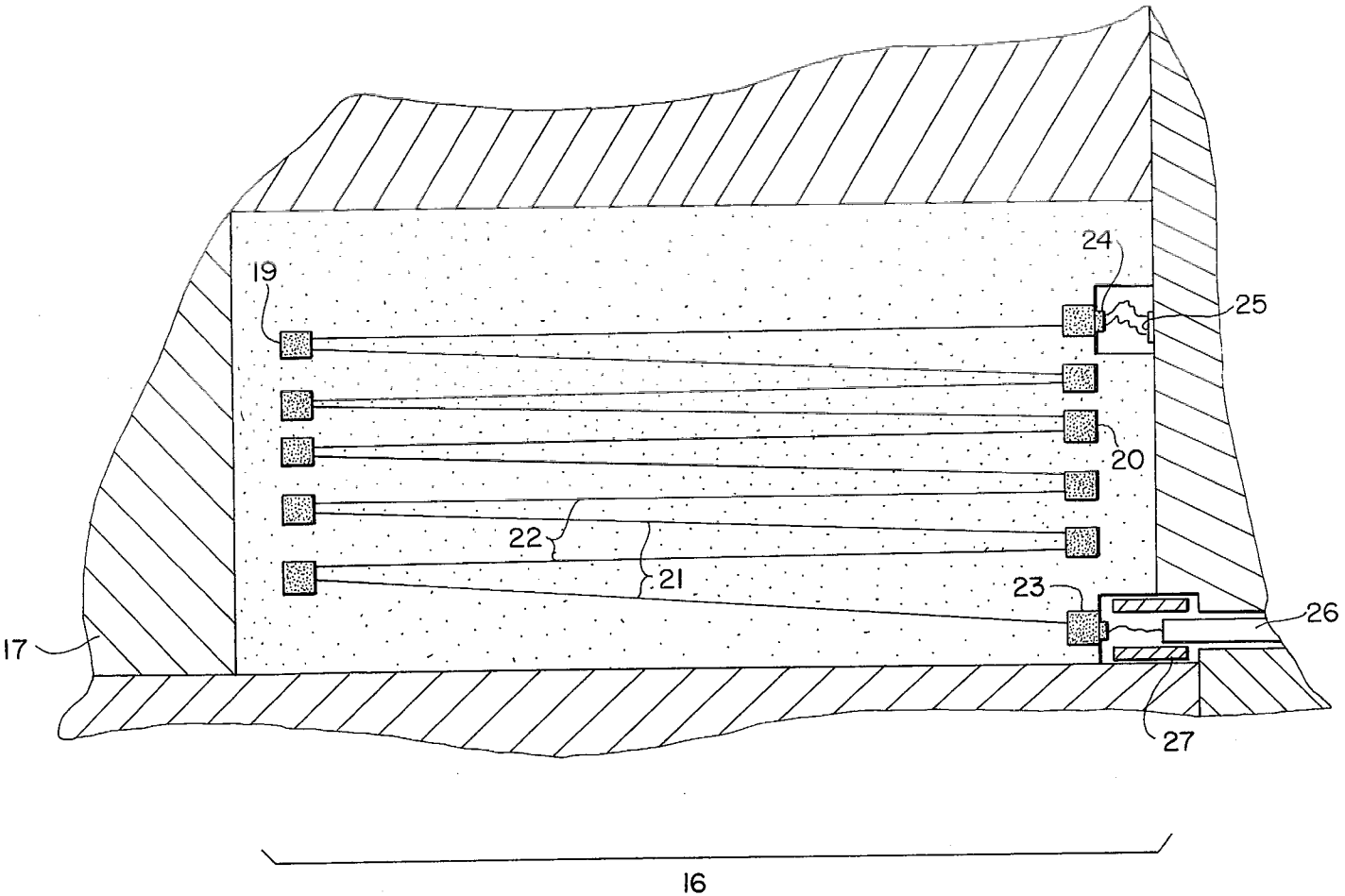

FIG. 2 is intended to show the device 16 in more detail, and the hot soldering points are designated 19 and the cold points 20. The device comprises a number of wire elements 21 and 22, connected in series and of two different types, the wire elements 21 consisting of e.g. an alloy of 97 % tungsten carbide and 3 % rhenium, and the wire elements 22 consisting of an alloy of 75 % tungsten carbide and 25 % rhenium. The end points in the series connection form an anode 23 and a cathode 24, the cathode 24 being connected to the projectile body via a wire 25 and the anode 23 being insulated from said body and, via a wire 26, being connected to the electronic equipment in the receiver unit 3. The insulation from the projectile body is achieved at the soldering point at anode 23 by means of a sleeve 27 made of insulating material and, for the rest, by the wire 26 being insulated.

Said soldering points and wire elements are insulated from each other in a ceramic member, which also increases the mechanical strength. The ceramic member can have the form of a cylinder divided in its longitudinal direction, or can be of a strictly cylindrical form, or some other form which is appropriate for the particular case in which it is used. The number of thermo elements employed is dependent upon the capacity the generator is to have and in this respect it can be mentioned that in the present cast approx. 40 mV is obtained from each thermo element at a temperature difference of approx. 2400°C between the hot and cold soldering points.

In the following, an example will be given of the load for a 40 mm projectile, which requires approx. 100 thermo elements connected in series, which load consists of the electronic equipment of the receiver unit 2.

Said electronic equipment comprises a detector 28 which in certain positions of the projectile in relation to a target is exposed to radiation reflected from the target via an ellipsoidal lens 29, a flat mirror 30 set at an angle and an interference filter 31, which has the result that the proximity fuze will be sensitive to radiation of a certain wavelength (the IR range). The equipment also comprises a transistor 32, an inductor 33 and amplifiers 34 and 35 with the connection resistors belonging to these. A gap igniter 36 comprised in the delayed-arming device 5 can be actuated by said circuit, which also comprises a contact 37 and a fuse 38 with which the proximity function can be paralyzed so that the projectile is initiated by means of an impact switch 39. An appropriate inductance in this connection has a value of 470 $\mu$H at 50 mA.

The circuit according to FIG. 3 functions in the following way. When the delayed-arming charge 11, which is ignited by the temperature in the barrel, has ignited the pyrotechnical charge 10 after a certain delay, e.g. 0.5 s, the membrane 12 is given its temperature by the charge 10. The heat energy obtained starts to generate electric power in the device 16, which causes the transistor 32 to receive base current from the operational amplifier 34 so that transistor 32 will become conducting, whereby current will also flow through the inductor 33. When thereafter a target along the trajectory of the projectile reflects radiation to the detector 28, the latter will generate a current corresponding to the detected radiation, which current is amplified in the amplifier 35. The amplifier 35 can thereby actuate the operational amplifier 34 so that the output signal from amplifier 34 will disappear, which cuts off the transistor 32 to produce a choking action. The inductance 33 will then cause the gap igniter 36 to operate, and the gap igniter then, in turn, in a way which is known in itself, causes actuation of the initiating members 6–7 and thereby also the charge 4.

The gap igniter 36 can also be made to function by means of an impact switch 39 which is connected in series with the collector-emitter circuit of the transistor 32. The proximity function is paralyzed by the contact 37 and the fuse 38 by means of a current, obtained externally from the firearm, which is conducted through the contact 37 to melt the fuse 38, with the result that no choking influence on the transistor can then be obtained from the operational amplifier 34.

The invention is not limited to the embodiment shown above as an example, but can be subject to modifications within the scope of the following claims.

I claim:

1. A projectile comprising a casing defining a space for a payload, said projectile including a source of heat spaced from said payload and adapted to be activated when said projectile is in its air trajectory, an electrical power-generating device located betweeen said heat source and the payload space, said power-generating device being of the thermocouple type and comprising a plurality of thermo elements which are interconnected to one another at a plurality of hot and cold junctions, said hot junctions being located adjacent said heat source and remote from said payload space, said cold junctions being located adjacent said payload space and remote from said heat source, said thermo elements comprising wires fabricated of alloys of tungsten carbide and rhenium, said wires being connected in series with one another at said hot and cold junctions respectively, one end of said series-connected wire elements being connected to the casing of said projectile and the other end of said series-connected wire elements being insulated from said casing, electrical equipment within said projectile adapted to be energized by said power-generating device, and an insulated conductor connecting said other end of said series-connected wire elements to said electrical equipment.

2. The structure of claim 1 wherein said heat source comprises a pyrotechnical charge, and a heat-dispersing medium located between said pyrotechnical charge and said hot junctions for causing each of said hot junctions to be heated to a substantially uniform temperature by the heat generated by said pyrotechnical charge.

3. The structure of claim 2 wherein said heat source comprises a membrane disposed adjacent said pyrotechnical charge and adapted to be heated to a comparatively high temperature by said charge, said heat-dispersing medium being in contact with said membrane.

4. The structure of claim 2 wherein said projectile is of elongated configuration, said pyrotechnical charge being located at a rear portion of said projectile, the space provided for said payload being located within said projectile at a position forward of said pyrotechnical charge, said power-generating device and heat-dispersng medium being located in a part of said projectile which separates said pyrotechnical charge from said payload, said part having a length in the longitudinal direction of said projectile which is substantially equal to the length of the space provided for said pyrotechnical charge.

5. The structure of claim 1 wherein said thermo elements are embedded within an insulating material.

6. The structure of claim 1 wherein said projectile includes a proximity fuze having a transmitter unit and a receiver unit, said heat source comprising a portion of the transmitter unit of said proximity fuze, said electrical equipment comprising the receiver unit of said proximity fuze.

* * * * *